US005601277A

United States Patent [19]

Larson

[11] Patent Number: 5,601,277

[45] Date of Patent: Feb. 11, 1997

[54] JACKING SYSTEM FOR TWO WHEELED VEHICLES

[76] Inventor: Raymond G. Larson, 14284 S. Elsbrook Cir., Draper, So. Mountain, Utah 84020

[21] Appl. No.: 628,191

[22] Filed: Apr. 5, 1996

[51] Int. Cl.[6] ..... B66F 7/22

[52] U.S. Cl. ..... 254/131

[58] Field of Search ..... 254/120, 131, 254/8 R, 94, 1; 414/447; 280/293; 211/22, 17; 248/352

[56] References Cited

U.S. PATENT DOCUMENTS

| | | | |
|---|---|---|---|
| 3,667,728 | 6/1972 | Garelick | 254/131 |
| 4,180,253 | 12/1979 | Ivers et al. | 254/131 |
| 4,193,582 | 3/1980 | Neilsen | 254/131 |
| 4,348,010 | 9/1982 | Baxter | 254/131 |
| 5,176,487 | 1/1993 | Flitton | 254/131 |
| 5,423,114 | 6/1995 | Johnson | 254/131 |
| 5,518,224 | 5/1996 | Anderson | 254/131 |

*Primary Examiner*—Robert C. Watson
*Attorney, Agent, or Firm*—Delbert R. Phillips

[57] ABSTRACT

The need for a simple lifting and leveling system for two wheeled vehicles is met by a jacking system and an adjustable stand. The jacking system is comprised of a base with a rotational member extending through two openings in the parallel sides of the base. A lever handle is attached to the rotational member. A lifting member with a resilient low friction surface is rigidly attached to the rotational member by supporting members. When the lever handle is pushed towards the surface upon which the vehicle rests the lifting member contacts the frame of the vehicle lifting the vehicle to a position of maximum height. The rotational member continues rotating past the zenith of rotation pressing the lever handle to the surface from which the motorcycle is being lifted stabilizing the vehicle. Optional locking mechanisms are incorporated into the jacking system to further insure that the rotational member is prevented from rotating after the vehicle has been lifted. The jacking system and the adjustable stand have means of height adjustment and leveling on each of the four corners of the base.

9 Claims, 4 Drawing Sheets

JACKING SYSTEM FOR TWO WHEELED VEHICLES

BACKGROUND OF THE INVENTION

Due to the popularity of motorcycles as a means of transportation and recreation, and as a hobby among the general public there is a need to provide uncomplicated low cost devices to help maintain, store and display motorcycles and other two wheeled vehicles. The present invention is uncomplicated light weight and portable. It facilitates maintenance as it holds the vehicle in a vertical stable position at various heights above the ground or floor surface which facilitates changing and checking oil, changing and repairing front or rear tires, changing belts or chains, and adjusting the clutch and the brakes. The present invention provides a means of storage of the vehicle with the tires elevated off the ground or floor in a upright position. Many people detail their motorcycles for exhibition. The present invention provides an ideal stand for cleaning, painting, and polishing the vehicle while it is in an upright position. The present invention is ideal for positioning and displaying a motorcycle at an exposition or convention.

U.S. Pat. No. 4,193,582 to Roger P. Neilsen describes and claims an apparatus to lift motorcycles. The device is composed of a lever member which is attached to a lifting member. The lifting member has supporting legs extending at right angles from the lifting member. When the lever member is forced down the lifting member engages the motorcycle frame and elevates the motorcycle as the supporting legs come in contact with the surface upon which the motorcycle rests.

U.S. Pat. No. 4,113,235 to Hartman Jr. is drawn to a lever action jack having a cross support and lever arms attached at opposite ends of the cross support. The lever arms are curved prior to their attachment to the cross support. The support member is placed under the motorcycle frame. As force is applied to the lever arms, the portion that is curved acts as a fulcrum causing the cross support to engage the frame thereby lifting the motorcycle.

The main draw back of these jacking systems is stability. They rely on lever mechanisms which employ the fulcrum principle. As the force is applied to the lever, slippage may occur at the fulcrum point. As the fulcrum point engages the ground or other surface there is a possibility of slippage against the motorcycle. These jacking mechanism also require a level surface on which to operate.

SUMMARY OF THE INVENTION

The present invention provides a system for raising and stabilizing two wheeled vehicles of up to 3000 lbs in weight. This system consists of a simple jacking mechanism with one moving part and an adjustable stand. The jacking mechanism consists of a frame having two parallel support members. The parallel support members are opposite each other and separated by two parallel connecting members. The parallel connecting members are attached to the parallel support members. The parallel support members and the parallel connecting members form a base having four corners. The parallel support members have openings which are opposite each other. A lever mechanism having a lever member is attached to a rotational member. The lever member may be pivotally attached to said rotational member in order to provide a means of adjusting the jacking mechanism to the various widths of the vehicles. The rotational member is pivotally supported by the openings in the supporting members. The rotational member has multiple lifting support members rigidly attached. The lifting support members are rigidly attached to a cylindrical lifting member. The cylindrical lifting member has a surface of resilient low friction material pliable enough to grip the vehicle without marring the finish of the vehicle. The multiple lifting support members are rigidly positioned on the rotational member in relationship to the lever to lift the cylindrical lifting member off the surface from which the motorcycle is being lifted when the lever is pushed towards the surface from which the motorcycle is being lifted, allowing the lifting member to pass the zenith of rotation and thereby forcing the lever arm against the surface providing a locking function. Two projections extend from the surface or the cylindrical lifting member to supply lateral stability to the vehicle that is being lifted. Height adjusting means are attached to each of the four corners of the base providing a method of adjusting the height of the base and providing a method of leveling the two wheeled vehicle on an uneven surface from which the motorcycle is being lifted. A locking mechanism can be fitted to the rotational member limiting the rotational movement of the rotational member. The locking mechanism can be a threaded rod projecting through a threaded aperture in the parallel support members. The tip of the rod contacts the surface of the rotational member inhibiting the rotation of the rotational member when the rod is in contact with the surface of the rotational member. The height adjusting means can be threaded bolts positioned on each of the four corners of the base projecting through the supporting members. The ends of these bolts contact the surface from which the motorcycle is being lifted providing a means to adjust the height and to level the two wheeled vehicle while it is being supported on the jacking mechanism. The supporting members may have an indentation in the outer surface that will accept an identification plate.

The adjustable stand consists of a supporting platform upon which a portion of the two wheeled vehicle may rest allowing both wheels to be off the surface from which the motorcycle is being lifted. The underside of the supporting platform is attached to a central support member. The central support member is fastened in a vertical position to a base plate. The base plate has height adjusting means at each it's four corners to adjust to an uneven surface from which the motorcycle is being lifted and to adjust motorcycle height for mechanical work or maintenance. The height adjusting means may be four bolts which are threaded through apertures in the base plate.

DETAILED DESCRIPTION OF THE INVENTION

Figure 1:
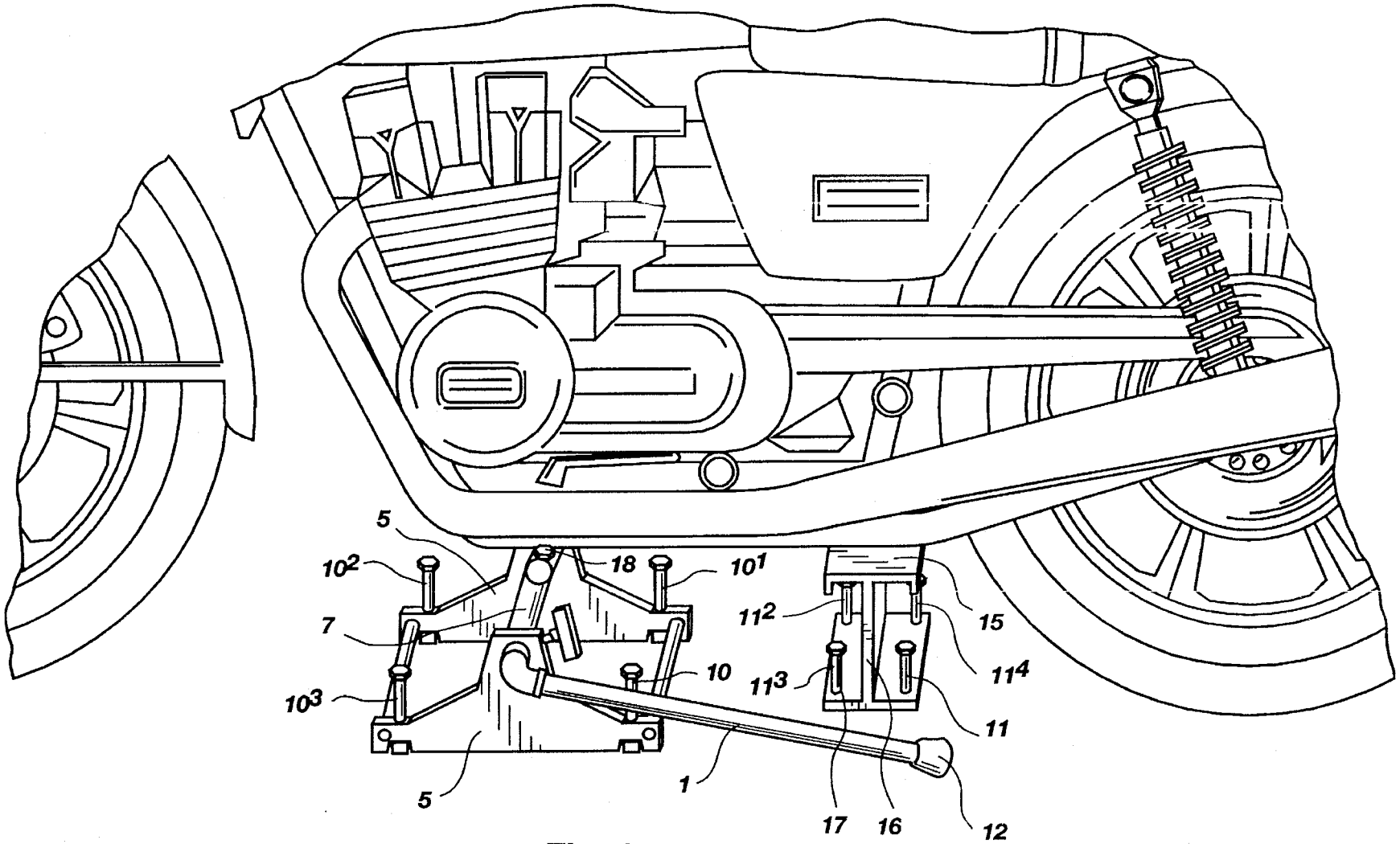
FIG. 1 depicts a motorcycle being raised and supported by the jacking mechanism and an adjustable stand.
Figure 2:
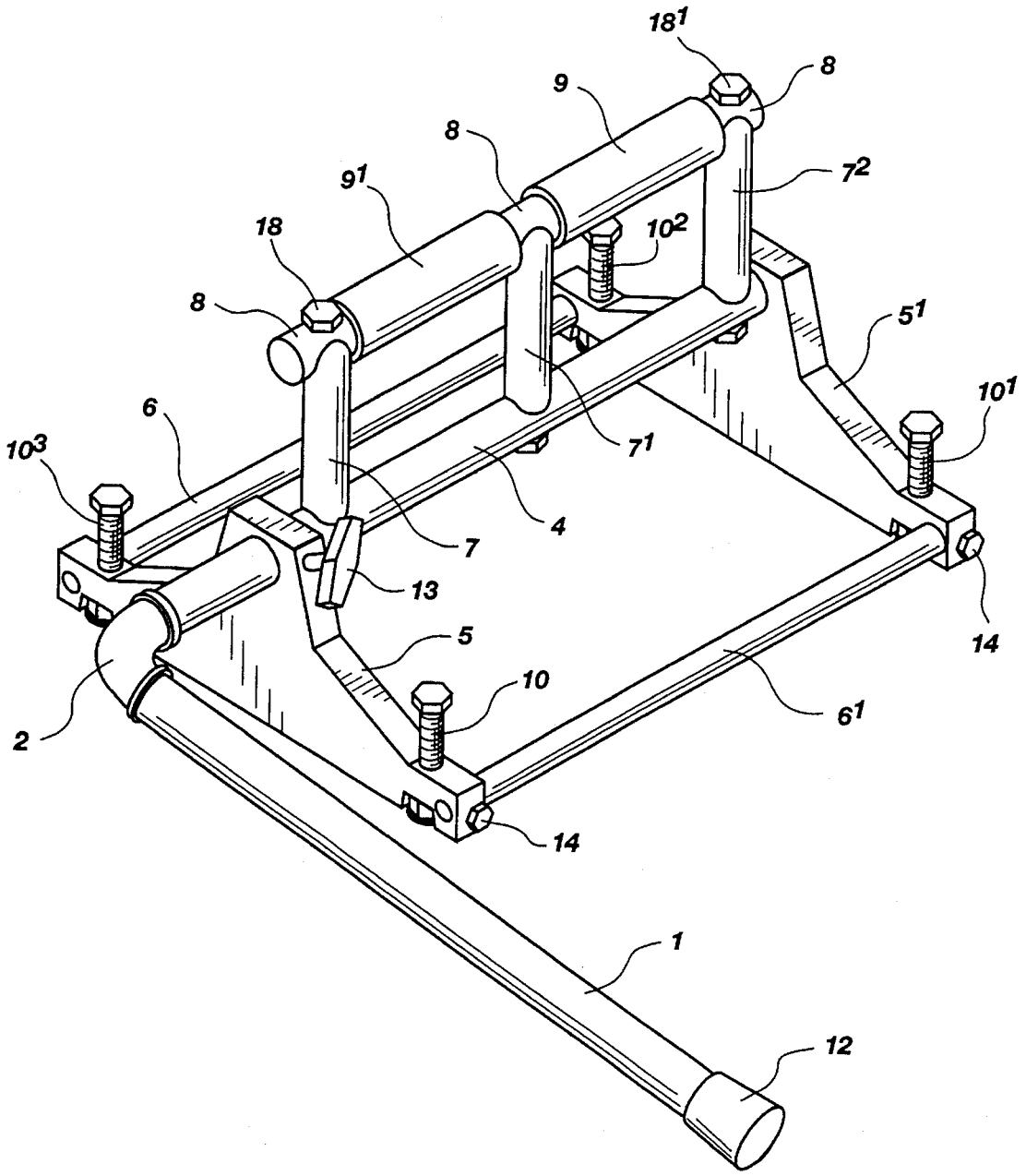
FIG. 2 is a full view of the jacking mechanism.
Figure 3:
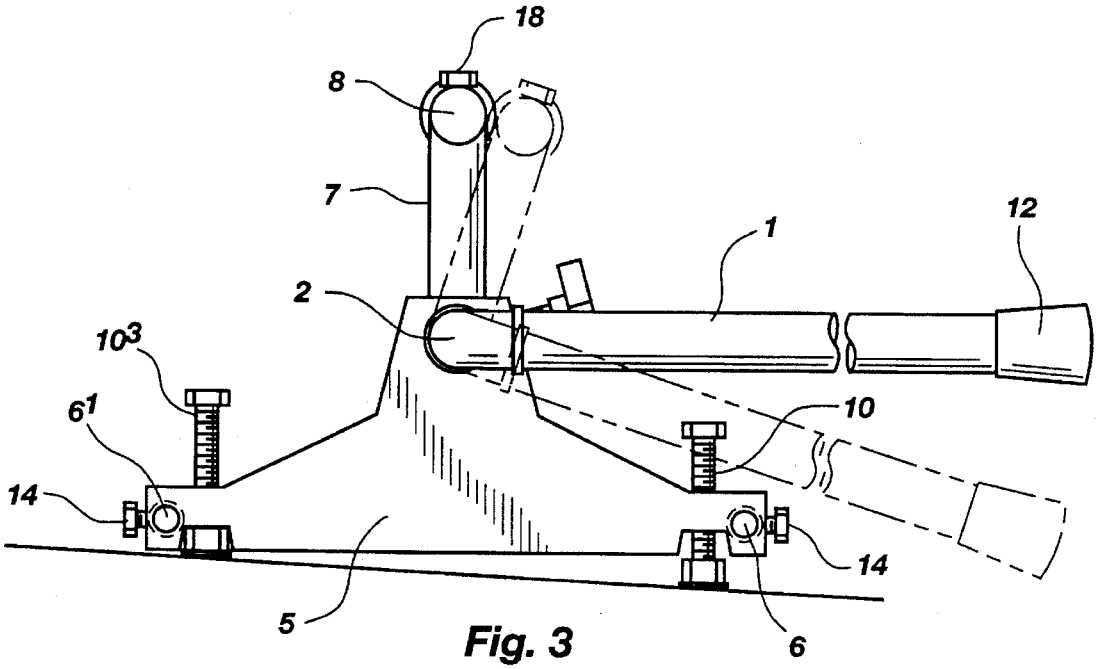
FIG. 3 illustrates a side view of the jacking mechanism at maximum lift showing the lifting member rotating past the zenith of rotation.
Figure 4:
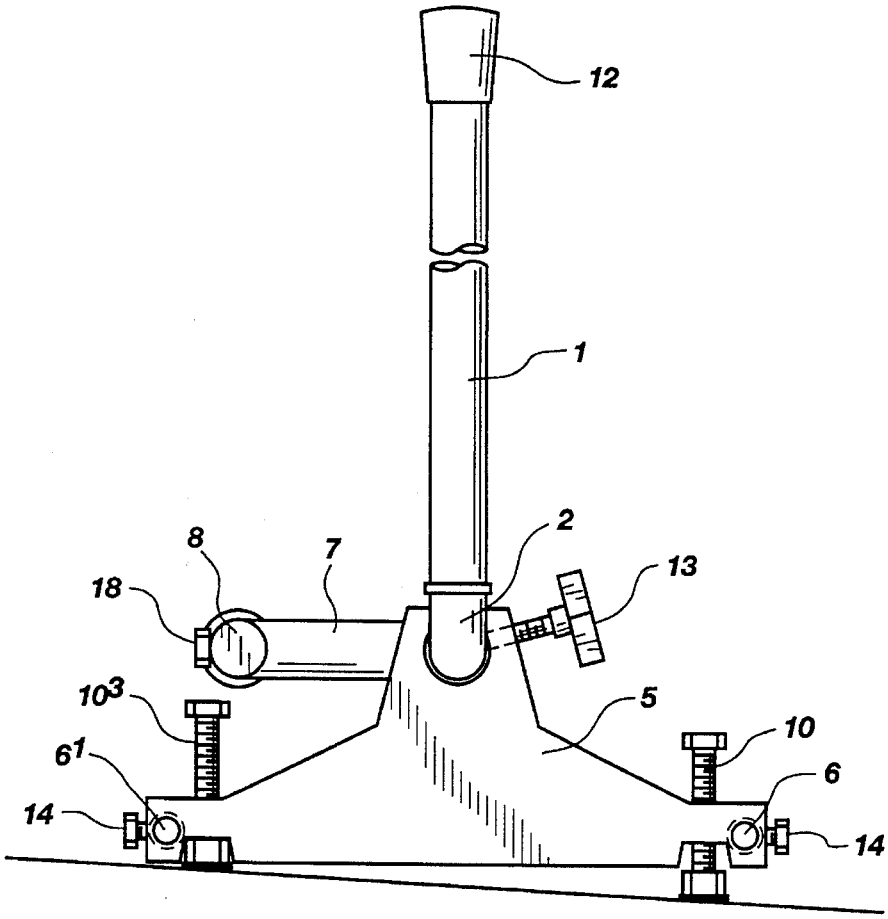
FIG. 4 illustrates a side view of the jacking mechanism with the lifting member in a horizontal position to the surface from which the motorcycle is being lifted before being positioned under the motorcycle.
Figure 5:
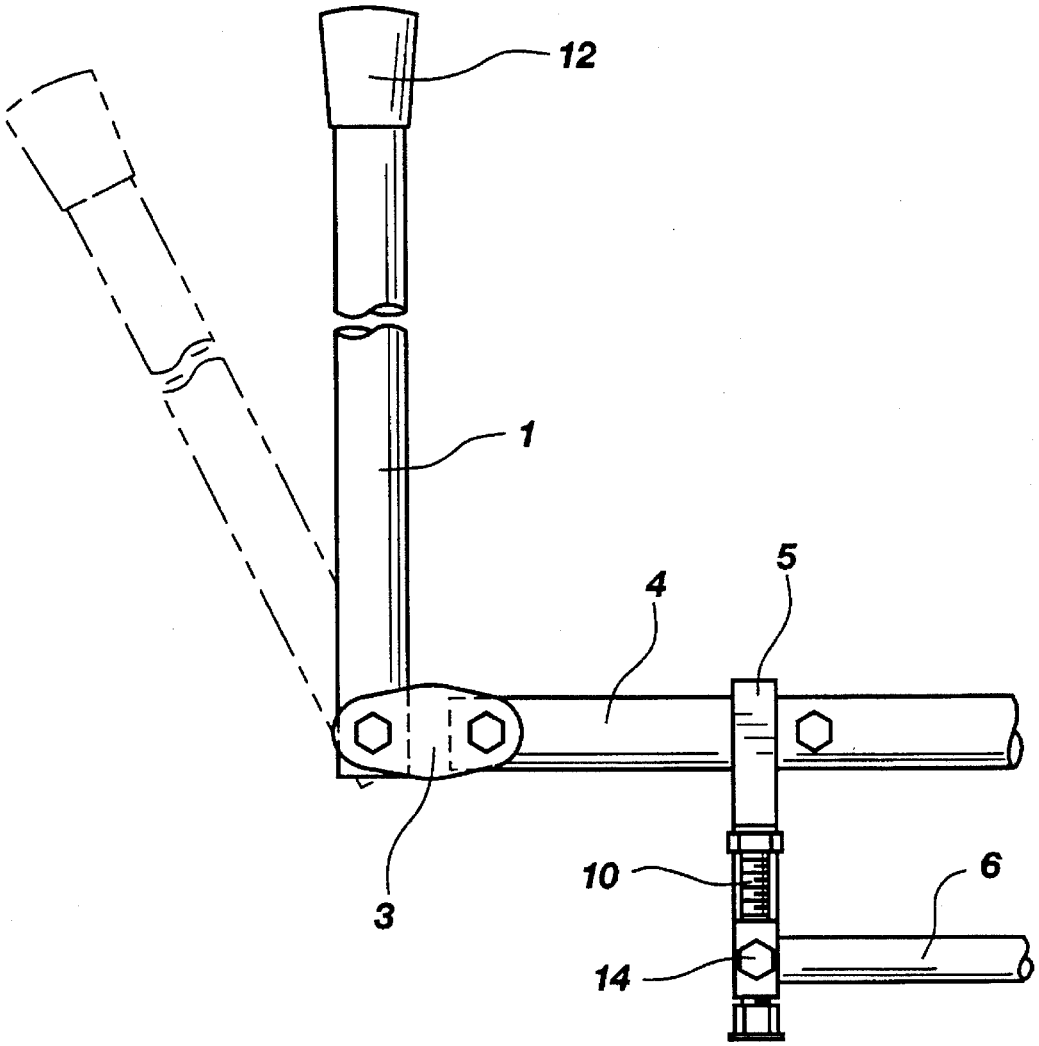
FIG. 5 shows an embodiment where the lever member is hingedly attached to the rotational member.

The jacking and stabilization system consists of two major parts; the jacking mechanism and an adjustable stand. The jacking mechanism as illustrated in FIG. 2 consists of a lever member 1 with a cap 12, attached through a coupling mechanism either an elbow 2 or a hinge coupler 3 to a rotational member 4 which can be a pipe or solid cylindrical bar. The purpose of the optional hinge coupler 3 is to allow the lever 1 to extend past peddles or such protrusions of the motor cycle as the lever is raised or lowered from the surface upon which the motorcycle rests. The elbow 2 could also be angled to avoid peddles and protrusions however the solid construction elbow would not be as versatile.

A base is formed from parallel support members 5 and 5$^1$ which are fastened together by rods 6 and 6$^1$. Bolts 14 are threaded through base support members 5 and 5$^1$ into 6 and 6$^1$ to form a base for the jacking mechanism. A shaft 4 extends through parallel support members 5 and 5$^1$. Lifting support members 7, 7$^1$, and 7$^2$ are attached to shaft 4. Lifting members 7, 7$^1$, and 7$^2$ are positioned in relationship to lever 1 to raise the cylindrical lifting member 8 to a center position of maximum height from said surface from which the motorcycle is being lifted and lowering said cylindrical lifting member 8 slightly past the zenith of rotation to provide force on lever member 1 pressing lever member 1 against the surface from which the motorcycle is being lifted. Preferably the relationship between lever 1 and lifting support members 7, 7$^1$, and 7$^2$ is a 45° angle, however other angles may be used so long as cylindrical lifting member 8 is able to rotate past the zenith of rotation and also provide enough leverage to lift the motorcycle. Sleeves of resilient low friction pliable material 9 such as self lubricating nylon or other similar materials are solidly attached to cylindrical lifting member 8. These sleeves 9 can also be frictionally attached to lifting member 8. The heads of bolts 18 and 18$^1$ extend from the surface of cylindrical lifting member 8 providing stabilization from lateral movements of the motorcycle. These sleeves provide a non marring surface for lifting and supporting the motorcycle. Height adjusting bolts 10, 10$^1$, 10$^2$ and 10$^3$ are threaded through parallel base members 5 and 5$^1$ to contact the surface from which the motorcycle is being lifted. When bolts 10, 10$^1$, 10$^2$ and 10$^3$ are individually adjusted they provide a means of adjusting the height and leveling the jacking mechanism. Extra rigidity and locking safety is accomplished by slightly tightening bolts 10, 10$^1$, 10$^2$ and 10$^3$ so the bolt tips engage the surface from which the motorcycle is being lifted. An optional locking screw 13 is threaded through parallel base member 5. When tightened against rotational member 4, locking screw 13 provides additional method of locking rotational member 4 in position when the motorcycle is lifted. Also locking screw 13 when tightened provides stability for lever member 1 when jacking mechanism is being transported.

The other component of the jacking system is a support stand composed of a platform 15 attached by a center support 16 to a platform base 17. Platform base 17 has four adjusting screws 11, 11$^1$, 11$^2$, and 11$^3$ which are threaded through platform base 17 at each corner and allow for leveling the stand on uneven surface from which the motorcycle is being lifted.

I claim:

1. A jacking mechanism for raising and stabilizing a two wheeled vehicle from a surface from which the motorcycle is being lifted comprising;

a frame having two parallel support members;

said parallel support members being opposite each other and separated by two parallel connecting members;

said parallel connecting members being attached to said parallel support members; said parallel support members and said parallel connecting members forming a base having four corners;

said parallel support members having an opening;

said openings in said support members being opposite each other;

a lever mechanism;

said lever mechanism having a lever member;

said lever member being attached to a rotational member;

said rotational member being pivotally supported by said openings in said supporting members;

said rotational member having multiple lifting support members rigidly attached;

said lifting support members being rigidly attached to a cylindrical lifting member;

said cylindrical lifting member having a resilient low friction surface pliable enough to grip said vehicle without marring the finish of said vehicle;

said multiple lifting support members being positioned on said rotational member in relationship to said lever member to raise said cylindrical lifting member to a center position of maximum height from said surface from which the motorcycle is being lifted and lowering said cylindrical lifting member slightly past the zenith of rotation to provide force on the lever member pressing said lever member against said surface from which the motorcycle is being lifted;

and height adjusting means being attached to each of said four corners of said base providing a method of adjusting the height of said base and providing a method of leveling said two wheeled vehicle.

2. A jacking mechanism as claimed in claim 1 wherein a locking mechanism is fitted to said rotational member limiting the rotational movement of said rotational member.

3. A jacking mechanism as claimed in claim 2 wherein said locking mechanism is a threaded rod projecting through a threaded aperture in one or more of said parallel support members, contacting the surface of said rotational member inhibiting the rotation of said rotational member when said rod is tightened against said rotational member.

4. A jacking mechanism as claimed in claim 1 wherein said height adjusting means are threaded bolts positioned on each of the four corners of said base projecting through said supporting members while contacting said surface providing a means to adjust the height and to level said two wheeled vehicle while said vehicle is engaged by said jacking mechanism.

5. A jacking mechanism as claimed in claim 1 wherein said resilient surface of said lifting member is a sleeve of lubricating nylon attached firmly to said lifting member.

6. A jacking mechanism as claimed in claim 1 wherein said lever member is hingedly attached to said rotational member to provide adjustment to the various widths of said two wheeled vehicles.

7. A jacking mechanism as claimed in claim 1 wherein projections extend from the surface of the cylindrical lifting member to stabilize lateral movement of said vehicle.

8. A system for lifting and stabilizing a two wheeled vehicle comprising;

a jacking mechanism as claimed in claim 1 and;

an adjustable stand having a supporting platform supported by a central support member;

said central support member being attached to the under side of said supporting platform;

said central support member being fastened in a vertical position to a base plate;

said base plate having height adjusting means at each its four corners to adjust the height and to level the vehicle.

9. A system for lifting and stabilizing a two wheeled vehicle as claimed in claim 1 wherein said height adjusting means for said base plate are bolts threaded through said base plate at said four corners.

* * * * *